US005618117A

United States Patent [19]

Yoshida et al.

[11] Patent Number: 5,618,117

[45] Date of Patent: Apr. 8, 1997

[54] ROLL PAPER TYPE RECORDING UNIT

[75] Inventors: Naoki Yoshida; Toshiharu Tamura, both of Tokyo, Japan

[73] Assignee: Altech Company Limited, Tokyo, Japan

[21] Appl. No.: 520,262

[22] Filed: Aug. 28, 1995

[30] Foreign Application Priority Data

Aug. 31, 1994 [JP] Japan ..... 6-206826

[51] Int. Cl.[6] ..... B41J 2/325

[52] U.S. Cl. ..... 400/120.04; 400/120.02

[58] Field of Search ..... 400/615.2, 617, 400/120.02, 628, 120.01, 120.03, 120.04, 611, 578, 120 MP; 101/408; 347/172, 174, 176, 218, 219

[56] References Cited

U.S. PATENT DOCUMENTS

| | | | |
|---|---|---|---|
| 5,080,512 | 1/1992 | Schofield et al. | 400/120.04 |
| 5,124,724 | 6/1992 | Hatakeyama et al. | 346/76 PH |
| 5,255,012 | 10/1993 | Amano | 346/76 PH |
| 5,465,110 | 11/1995 | Carlotta et al. | 400/578 |

FOREIGN PATENT DOCUMENTS

| | | | |
|---|---|---|---|
| 139462 | 6/1986 | Japan | 400/120 |
| 104862 | 5/1988 | Japan | 400/120 |
| 34755 | 2/1989 | Japan | 400/120 |
| 4-344261 | 11/1992 | Japan | 347/176 |
| 405138904 | 6/1993 | Japan | 347/218 |

*Primary Examiner*—Edgar S. Burr
*Assistant Examiner*—Daniel J. Colilla
*Attorney, Agent, or Firm*—McGlew and Tuttle

[57] ABSTRACT

A paper guide printer with simple structure, high positioning accuracy and color print of excellent picture quality. The printer/recording unit includes a platen roller, a roll type recording paper which is pulled and fed on the platen roller and a recording head. A recording paper pull-feed mechanism is installed which includes a clamp opening closing unit for catching the end of the roll type recording paper and for making the linear reciprocation movement by the designated cycles at every recording in accordance with the length of main run direction being recorded at one time, and also the roll paper drum that can be turned in reverse direction for pulling back the recording paper when the roll type recording paper reciprocates at the designated cycles.

8 Claims, 2 Drawing Sheets

ROLL PAPER TYPE RECORDING UNIT

FIELD OF THE INVENTION

The present invention relates to a recording unit for recording the letters, figures, photos, etc. on a roll paper rolled around the drum. This invention is especially useful for color printer using a color sublimation type ribbon and a thermal head.

BACKGROUND OF THE INVENTION

Printers are known and available that selectively give an impact force to the transcription material by a solid ball or a print wire, that form an ink jet by heat, vibration, electric field and magnetic field, that selectively give heat to the transcription material using a thermal head and that selectively give heat to the heat sensitive recording paper using a thermal head.

In recent years, the need for the realization of color in printing is high, and the professional use of universal type printers as well as business use printers is expanding especially in the field of CAD and computer graphics.

However, because a variety of conventional printers use cut paper in many cases, the transfer route of paper inside the unit essentially becomes complex, and as a result, makes the enlargement of recording paper and the maintenance difficult. These matters are important especially in the case of the color printer. In the color printer which prints 3 colors and black 4 times, the complex paper transfer route makes it difficult to enhance the positioning accuracy, and the color picture quality is insufficient. This has resulted in a vicious cycle requiring the more complex mechanism for enhancing the positioning and picture quality.

On one hand, there is a method for using a roll paper instead of cut paper, and it was proposed to print 4 times on the same face by rolling the recording paper around a large size drum and turning the drum 4 times. In this method, the unit scale essentially becomes greater because a large size drum is required for printing large paper and a plurality of drum diameters are needed for obtaining various sizes of printed face (various sizes of fonts or print face).

Further, there is the method for installing a plurality of roller units before and after the platen roller and repeatedly pulling and feeding the recording paper several times in forward and reverse main run directions, but the paper feeding mechanism which is the most important point is poor in practical use.

SUMMARY AND OBJECTS OF THE INVENTION

An object of this invention is to provide a printer, especially a color printer whose construction is simple, whose printing accuracy is high by enhancing the positioning accuracy, and using the roll paper which allows for excellent picture quality of resolution and gradation, etc.

As a result of ardent study, the inventors have found out that the problems can be solved by using a clamp opening/closing unit for catching the end of roll type recording paper and making the linear reciprocation movement by the designated cycles, and have reached the present invention.

According to the invention, a recording (printing) unit is provided, including a platen roller, a roll type recording paper which is pulled and fed on the platen roller and a recording head, wherein the recording pull/feed mechanism is installed which consists of a clamp opening/closing unit for catching the end of the roll type recording paper and making a linear reciprocation movement by the designated cycles at every recording in accordance with the main run direction being recorded at one time and a roll paper drum that can be turned in a reverse direction for pulling back the recording paper when the roll type recording paper reciprocates by the designated cycles.

The designated cycles of linear reciprocation movement are preferably done by the clamp opening/closing unit being set to 4 cycles in total of yellow, magenta, cyan and black of color printing or to 3 cycles in total of yellow, magenta and cyan.

The recording unit is preferably a thermal transcription recording unit whose recording head is the thermal head. The thermal transcription recording unit may be a sublimation type thermal transcription having an ink ribbon mechanism for pulling and feeding the sublimation type thermal transcription ribbon between the thermal head and the recording paper.

A cutter unit is preferably disposed between the clamp opening/closing unit of the recording unit and the paper discharging port. The clamp opening/closing unit preferably includes the clamp plate for catching the end of roll type recording paper, one or more than two clamp rubbers, a clamp arm having a clamp rubber capable of pressing the paper by the clamp spring, a clamp releasing lever for slackening the push pressure of clamp arm, a gear with a cam for operating the release lever, and one set of paper discharging rollers for feeding the recording paper to the cutter unit. The clamp opening/closing unit preferably has the roller mechanism for catching the end of roll type recording paper only with the roller to idly feed the paper toward the paper discharging direction in order to correct the distortion of recording paper.

The recording unit preferably has a pulse motor (stepper motor) and a timing belt as the mechanism for giving to the clamp opening/closing unit the linear reciprocation movement being done by the designated cycles at every recording (every print) in accordance with the length of the main run direction. The platen roller preferably turns following the movement of clamp opening/closing unit and paper.

The recording unit of this invention may be the unit printing the roll type recording paper using a head, and should not be limited especially. For example, for recording using recording energy, there is heat sensitive recording for making the heat head contact the recording paper for its coloring by heating it, and the heat transcription recording for transcribing the ink on transcription film to the recording paper by heating it, and moreover, the heat transcription recording can be classified into the fusion type heat transcription using a sublimation type ink sheet which is fused by heat application and the sublimation type heat transcription using a sublimation type ink sheet wherein the sublimation dye sublimates via the heat application from the rear face of dye layer and is diffused and molten into the receiving layer of recording paper for its coloring. As the recording using the pressure as the recording energy, there are the pressure sensitive recording for coloring in chemical change by pressurization, and the ink jet system for controlling the release and jet of ink drips with pressure for adhering it to the recording paper. Various systems have been developed in this ink jet system, but among them, it can be largely classified into the on-demand type and the continuous type. The on- demand type covers the electric/mechanical change-over system, electric/heat change-over system and electrostatic suction system. Among them, the bubble jet system and thermal ink jet system using the thermal head are suitable for this invention. Besides them, there are the electric heat sensitive recording and electrostatic recording using the electric current and the recording using the light and magnet as the recording energy, and a variety of recording (printing) systems can be applied to this invention.

Among known recording/printing systems, those using a thermal head, especially as the head, are suitable for the recording unit of this invention in respect of the controllability, resolution and gradient, and the heat sensitive recording, fusion type thermal transcription, sublimation type thermal transcription and bubble jet are preferable. Out of them, especially the sublimation type thermal transcription has such advantages that it is high in gradient and has a high reproducibility of picture density, its gradation in low density area is smooth, high density can be obtained, and in addition to the picture quality problem that it has a high resolution, the unit is comparatively compact and can be made lower in price, the maintenance is easy, the output time is short and higher speed can be obtained, and these features are especially effective for the color printer or one of the object of this invention.

The roll type recording paper used in this invention is rolled around the core of reel or drum in a continuous state instead of the sheet which is used for each of the recording systems. For example, in case of the sublimation type thermal transcription, the picture receiving paper is used where the receiving layer, which is designed to absorb the dye, is provided on the smooth basic material and the parting layer for preventing the thermal fusion with the transcription film is provided on the receiving layer surface.

The roll type recording paper is recorded by each of the recording systems when it passes through between the printing head and the platen roller. For example, in the sublimation type thermal transcription, in addition to the picture receiving paper, an ink ribbon is used where the dye layer containing the sublimation type dye is provided on one side of base film of polyester thin film and the like and the transcription film provided with a heat resistant smooth layer is rolled up on the rear face. The transcription film is overlapped with the picture receiving paper, and when it is passed between the thermal head and the platen roller, the sublimation dye sublimates and is fused in dispersion into the receiving layer for its coloring by heating the dye layer instantaneously from its rear face at a high temperature. The full color picture can be obtained by outputting and overlapping in one color each the transcription films of yellow, magenta, cyan and black in sequence using the thermal head. It is noted that the case of not using black in the color is also included in the present invention.

In the recording system using the ink ribbon such as the sublimation type thermal transcription, a single color ribbon in case of a single color and a multi color ribbon in case of multi colors is used and in case of the multi color ribbon, there are the stripe coating system and the uneven coating system, in the present invention, the face sequential system for recording each picture in line system, for example having the dye layers of yellow, magenta, cyan and black in face sequence is preferable. It is noted that the order of these dye layers may be differed.

The ink ribbon to be rolled around the reel will be rolled sequentially around the reel together with the passage of its recording head, but the roll type recording unit is clamped at its tip and linearly pulled out in the main run direction by the length necessary for one picture area by the clamp opening/closing unit.

The action of clamp opening/closing unit is important in this invention, and first the tip of roll type recording paper is pressed against the metallic portion by the clamp made of one or more than one rubber pieces, and moreover has a releasing mechanism as described later for the push pressure to the tip of recording paper. Secondly, the clamp opening/closing unit pulls out the recording paper and pulls back the recording paper by the reverse turning force of roll paper drum. And, the clamp opening/closing unit makes a linear reciprocation movement between the closest position (initial position) and the remotest position (pull-out position) to the platen roller and the recording head. Thirdly, the unit idly feeds the paper prior to the actual printing, namely one time in case of single color and four or three times in case of multi colors. The idle feed of paper means that, after the tip of roll paper is clamped only by the roller without the printing by the head and the paper has been pulled out in paper discharging direction by the length necessary for one picture, the roll paper is to be rolled back. Utilizing the nature of compensating for the phenomenon for the paper to swing to the right and left rectangularly against the main run direction from the correct position, called a skew, and of correcting the distortion owned by the paper itself, then the roll paper is rolled back to the original position by the reverse turning force of roll paper drum. Fourthly, regardless of single color or multi colors, after the end of printing of one picture (graphic image/text), the clamp opening/closing unit returns once back to the original position, then the roller inside the clamp opening/closing unit turns at the same when the clamp is slackened, to feed the printed recording paper of one picture portion to the paper discharging portion.

As described above, the drum on which the roll type recording paper is rolled in this invention turns in the forward direction to feed out the recording paper when the tip of recording paper is pulled out by the clamp opening/closing unit, but when the clamp opening/closing unit returns to the initial position from the pull-out position, the unit rolls back the recording paper by one picture portion in the main run direction by the reverse turning force applied on the roll paper drum. It is noted that the main run direction in this specification means the direction where the roll paper passes between the platen roller and the head by the roll paper drum toward the paper discharging port.

The function and construction of the printing head, in this invention, can be changed widely by adopting any of the recording/printing systems. Namely, the function and construction of the head changes depending on the kind of recording system energy. For example, various printers depending on the electric, pressure, heat, light and magnetic energies have already been known, and these constructions are adopted also in this invention. Out of them, the thermal head is excellent not only in such functional aspects as printing density, high speed, low noise and controllability but also in such structural aspects as unit realization and compact size realization, and is best suited for the present invention.

In this invention, the drive force for linearly reciprocating the clamp opening/closing unit between the initial position and the pull-out position needs to have a high accuracy in order to enhance the paper positioning accuracy. A pulse roller has a high accuracy but it is high in price, and therefore, it becomes possible to obtain the linear reciprocation movement of desired high accuracy, for example, by providing the gears for linearly moving the unit outside the clamp opening/closing unit, fitting a timing belt to it where the teeth are provided at constant distance on the rubber belt and by turning the timing belt with the pulse motor.

The roll type recording paper, whose printing has been ended at the designated cycles and has been monochromed or colored, is un-clamped at the initial position, and fed toward the paper discharging direction by one set of paper discharging rollers arranged upper and lower side adjacent to the clamp. The roll paper may be cut manually or semimanually, but it is also acceptable to install a desired cutter unit in the midway from the clamp opening/closing unit at the initial position to the paper discharging port. One set or more than one set of rollers can be provided, if so necessary, before and after the cutter unit, namely on the channel to the paper discharging port from the clamp opening/closing unit via the cutter unit. By installing the cutter unit, the roller type recording paper can be sequentially accumulated on the paper discharging port in the form similar to the usual cut paper.

In addition, a variety of sensors for detecting the position of recording paper, ink ribbon, clamp opening/closing unit and the end of paper, head driving circuit and memory, cooling fan, inputting/outputting connectors, over- current breakers, motors for driving various parts, switches for maintenance, etc. can be installed as necessary to the recording unit of this invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings.

FIG. I is an overall view of one embodiment of recording unit according to this invention.

DETAILED DESCRIPTION OF THE PREFERRED EMBODIMENTS

Figure 1:
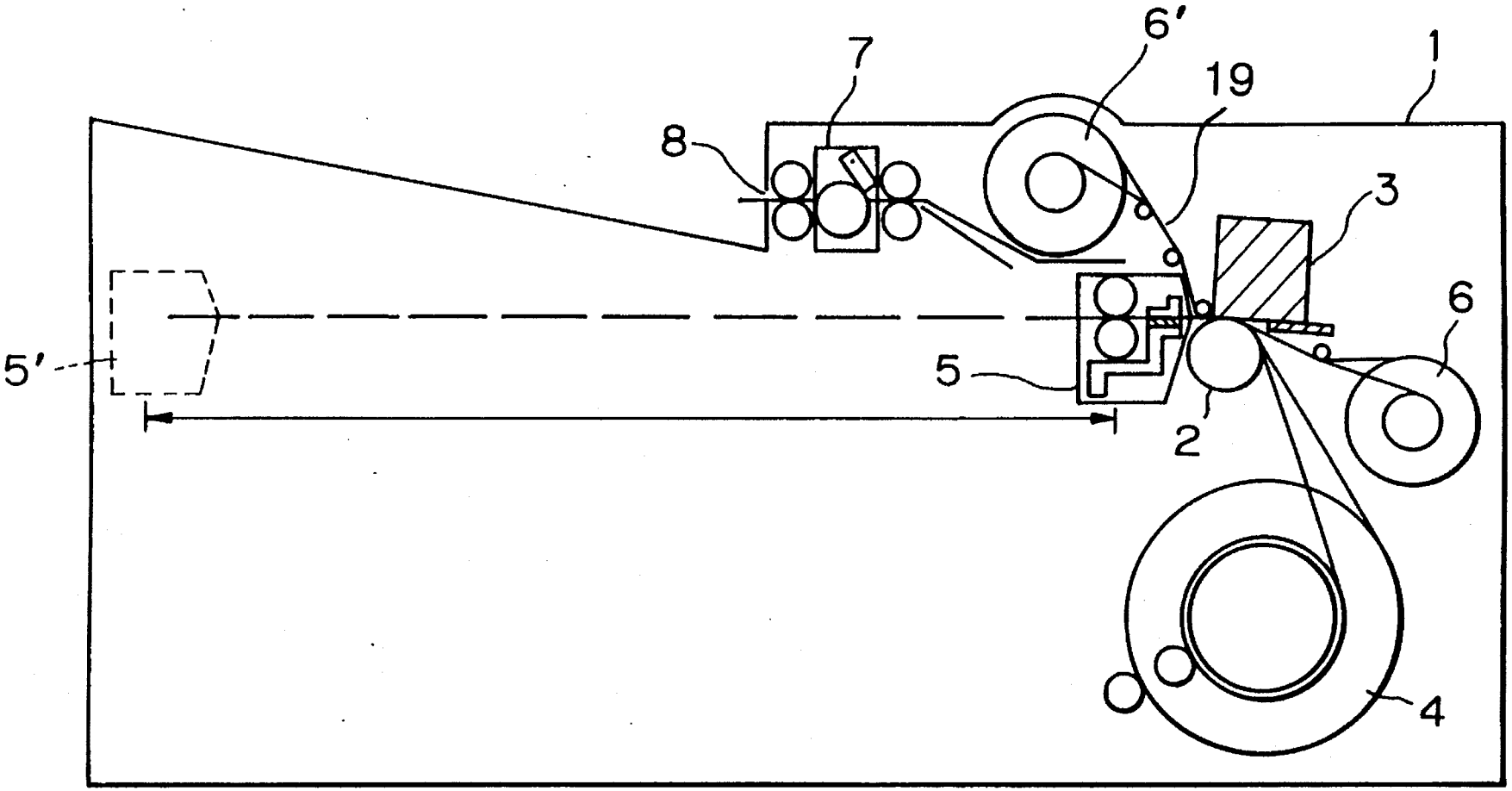

Referring to the drawings in particular, FIG. 1 is a sectional view showing a color printer of sublimation type thermal transcription. In FIG. 1, the roll type recording paper 4 is rolled around a paper supply drum and the sublimation type ink ribbon 19 having the dye layers in face sequence of yellow, magenta, cyan and black are pulled and fed between the platen roller 2 and the thermal head 3 inside the recording unit 1. The tip of roll type recording paper is clamped by the clamp opening/closing unit 5. The clamp opening/closing unit linearly reciprocates along a reciprocation path between the initial position shown by 5 and the pull-out position shown by 5' with the length shown by arrow mark in the figure as the maximum extent. Its drive source is not shown in the figure, but the linear reciprocation movement of high accuracy can be obtained by installing the gears to the outside of clamp opening/closing unit, fitting a timing belt to it and turning the timing belt with a pulse motor.

A cutter unit 7 is installed between the clamp opening/closing unit 5 and the paper discharging port 8, and the paper cut to the designated size is discharged from the paper discharging port. The ink ribbon is fed in face sequence of yellow, magenta, cyan and black by two drums 6 and 6'.

Figure 2:
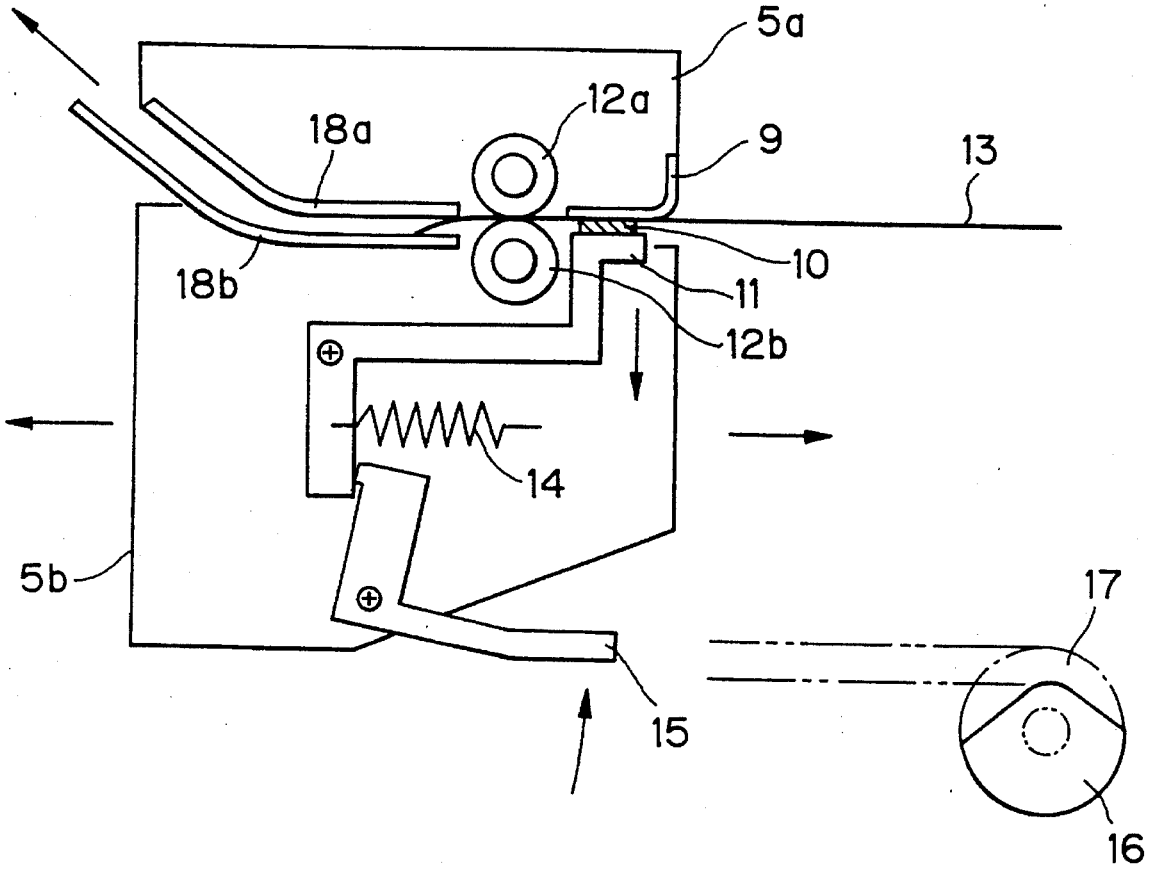
FIG. 2 is a sectional view of clamp opening/closing unit according to the invention.

FIG. 2 is a detailed sectional view of clamp opening/closing unit 5. The clamp opening/closing unit is roughly structured to include an upper unit **5*a* and a lower unit 5*b*. For the maintenance sake, the upper unit 5*a* should preferably be opened and closed. The tip 13 is pulled out of the roll type recording paper 4 and is clamped by the clamp rubber 10 provided on the clamp arm 11 and by the clamp plate 9 made of metal. The entire clamp opening/closing unit 5 in its state of clamping the paper linearly reciprocates in the arrow marked direction. The clamp rubber 10** need not be one piece, and for equalizing the push pressure, several pieces, for example, six pieces of clamp rubber should preferably be arranged in division according to the width of recording paper.

As regards the opening/closing of clamp arm 11, the moving clamp opening/closing lever 15 shall be turned in the arrow mark direction in the figure by turning the gear 17 with cam 16, and this clamp opening/closing lever 15 turns the clamp arm 11 in the arrow marked direction against the clamp spring 14 for releasing the clamp. The push pressure by the clamp is in action the reverse, and the paper 13 is pressed between the clamp rubber 10 and the clamp plate 9 by the tensile force of clamp spring 14.

One set of paper discharging rollers **12*a* and 12*b* exist adjacent to the clamp rubber 10 and the clamp plate, and the recording paper 13 whose printing has ended in one picture portion is fed to tile cutter unit 7 installed in the paper discharging direction between the upper and lower paper guides 18*a* and 18*b*. The discharging rollers 12*a*, 12*b* and the paper guides 18*a* and 18*b*** form a discharge feed means.

In addition to the explanation of tile mechanism, the action during the recording is to be explained. The clamp opening/closing unit 5 which has clamped the tip 13 of recording paper by releasing and closing the clamp at its initial position moves the paper by the length in a main run direction is recorded one time to the left side linearly while idly feeding out the paper only with the roller without activating the recording head by the timing belt and the pulse motor which are not shown in the figure. After this, because the reverse turning force is given to the roll paper drum 4, the recording paper 13 returns to its initial position without any sagging. When this occurs, the distortion called a skew caused to the recording paper 13 is corrected, the tip portion of recording paper swings to the direction rectangular to the main run direction by the recording paper itself and returns to the correct position. In this way, the idle feeding action of recording paper is important in this invention for correcting the skew, and especially in case of the color print, contributes greatly to the enhancement of picture quality because four color or three color printing thereafter are to be positioned correctly.

Next, the printing is made one time in case of the single color, and three or four times in case of multi-color. With the tip of recording paper 13 being clamped, the clamp opening/closing unit 5 again pulls out the recording paper from its initial position by the timing belt and the pulse motor. During this pull-out, the first printing, for example, the black in case of black single color and the yellow in case of color will be printed on the recording paper by the thermal head 3 from the ink ribbon 6. As the recording paper is fed out, the ink ribbon passes between the recording paper 4 and the thermal head 3, and is rolled around from 6 to 6' between the drum or the reel. When the pull-out and the first printing by the clamp opening/closing unit 5 has ended and the clamp opening/closing unit has reached its pull-out position, the unit pulls back the recording paper with the tip of recording paper being clamped without loosening the clamp. Not only does the clamp opening/closing unit return to its original position but the pull-back also returns correctly to its original position by the reverse rotation given to the roll paper drum 4.

The process moves to the next paper discharging action if the printing is a single color, but in case of the color print where the effect of this invention is strongly exhibited, the clamp opening/closing unit repeats the same action as the case of the yellow color for the magenta, cyan and black, then returns to its initial position and shifts to the next paper discharging action. In this situation, all the printing has been recorded. For reference, the black is sometimes omitted in the color print.

In the paper discharging action, one set of paper discharging rollers 12*a* and 12*b* arranged adjacent to the clamp rubber 10 and clamp plate 9 inside the clamp opening/closing unit 5 starts its rotation, then the tip of clamped recording paper 13 is fed to the main run direction by the paper discharging rollers. The recording paper may be directly guided to the paper discharging port and accumulated into the tray and the like, but it is usually convenient to use the cut papers of designated size, and hence, in the embodiment, the recording paper guided by the upper and lower guides 18*a* and 18*b* is cut rectangularly, at a right angle to the main run direction with the cutter unit 7, and sequentially accumulated on the tray by the paper discharging port 8.

As described above, first the recording unit of this invention has a simple mechanism while it can record on (print) even a large size of paper. For this reason, the unit can be designed to a compact size, and the ease of use is greater and the maintenance is easy. Secondly, the positioning accuracy has been drastically enhanced and the printing accuracy and resolution has become higher by repeating the reciprocation movement of clamp opening/closing unit and by installing the idle feed mechanism for first correcting the skew. Therefore, printing which is excellent in picture quality such as gradation can be achieved especially in the color print. Thirdly, when the cutter unit is installed, the roll paper can be obtained as the final recorded/printed paper in the similar state to the usual cut paper. Fourthly, because the roll paper is used, this invention exhibits many excellent effects such that the paper can be set easily in addition to the action of clamp opening/closing unit.

While specific embodiments of the invention have been shown and described in detail to illustrate the application of the principles of the invention, it will be understood that the invention may be embodied otherwise without departing from such principles.

What is claimed is:

1. A printer/recording unit, comprising:

a platen roller;

roll-type recording paper, pulled and fed out on said platen roller;

a recording head;

recording roll feed means including a clamp opening/closing unit for catching an end of said roll-type recording paper and for moving with said end of said roll-type recording paper in a linear reciprocating movement along a reciprocating path between an initial position and a pull-out position, the paper being printed during each reciprocating movement between said initial position and said pull-out position;

roll-paper drum means for reversing the direction of said clamp opening/closing unit for pulling back the recording when the roll-type recording paper reciprocates during designated cycles cutter means stationarily mounted on the recording unit and for cutting said roll-type paper, said cutter means being positioned adjacent said initial position of said roll feed means:

discharge feed means positioned on said roll feed means and for feeding said roll-type paper from said roll feed means to said cutter means when said roll feed means is in said initial position;

discharge port means the recording unit and for discharging said roll-type paper from said cutter means to outside the recording unit, said discharge port means discharging the roll-type paper in a direction substantially parallel to, and adjacent with, said reciprocation path.

2. A recording unit according to claim 1, wherein said cycles are one of a set of 4 cycles, including a yellow print cycle, a magenta print cycle, a cyan print cycle and a black print cycle during color printing and set at three cycles, including a yellow print cycle, a magenta print cycle and a cyan print cycle.

3. A recording unit according to claim 1, wherein said recording head is a thermal head for thermal transcription printing.

4. A recording unit according to claim 3, wherein said unit comprises a thermal transcription recording unit for sublimation-type thermal transcription, including an ink ribbon mechanism for pulling and feeding a sublimation-type thermal transcription ribbon between said thermal head and said recording paper.

5. A recording unit according to claim 1, wherein:

said cutter means is disposed between said clamp opening/closing unit and said discharge port means.

6. A recording unit according to claim 1, wherein said clamp opening/closing unit comprises a clamp plate for catching an end of roll-type recording paper, a clamp arm having a clamp rubber for pressing a paper via a clamp spring, a clamp releasing lever for releasing a push pressure of said clamp arm, a cam with a gear for operating said releasing lever and one set of paper discharging rollers for feeding the recording paper to said cutter means.

7. A recording unit according to claim 1, further comprising a pulse motor and a timing belt for controlling said cycles of said clamp opening/closing in accordance with a length of said reciprocation path.

8. A printer/recording system comprising:

a recording unit;

a paper supply drum rotatably mounted on said recording unit;

roll-type recording paper wound around said paper supply drum;

a platen roller rotatably mounted on said recording unit and receiving said roll-type recording paper from said paper supply drum;

a recording head means mounted on said recording unit and for printing/recording on said roll-type paper as said roll-type paper passes between said recording head means and said platen roller;

roll feed means reciprocatingly mounted on said recording unit and for receiving said roll-type paper from said recording head means and said platen roller, said roll feed means reciprocatingly moving said roll-type paper along a reciprocation path between a first position adjacent said recording head means and a second position spaced from said recording head means, a location of said reciprocation path, and said first and second positions being inside said recording unit;

clamp means movable with said roll feed means and for catching and releasing an end of said roll-type recording paper, said clamp means moving with said end of said roll-type recording paper along said reciprocation path;

cutter means staionarily mounted on said recording unit and for cutting said roll-type paper, said cutter means being positioned adjacent said first position of said roll feed means;

discharge feed means positioned on said roll feed means and for feeding said roll-type paper from said clamp means to said cutter means when said roll feed means is in said first position;

discharge port means on said recording unit and for discharging said roll-type paper from said cutter means to outside said recording unit, said discharge port means discharging the roll-type paper from a position adjacent said cutter means and said first position, said discharge port means discharging said roll-type paper in a direction substantially parallel to, and adjacent with, said reciprocation path.

* * * * *